US007285061B2

(12) United States Patent
Wagner

(10) Patent No.: US 7,285,061 B2
(45) Date of Patent: Oct. 23, 2007

(54) SPORTS SKILLS TRAINING METHOD AND APPARATUS

(76) Inventor: Ervin Wagner, 2311 Old Lakeshore Rd., St. Joseph, MI (US) 49085

( * ) Notice: Subject to any disclaimer, the term of this patent is extended or adjusted under 35 U.S.C. 154(b) by 0 days.

(21) Appl. No.: 10/633,807

(22) Filed: Aug. 4, 2003

(65) Prior Publication Data

US 2005/0032581 A1 Feb. 10, 2005

(51) Int. Cl.
*A63B 69/38* (2006.01)

(52) U.S. Cl. ..... 473/459; 473/473; 473/474; 473/446; 473/422

(58) Field of Classification Search ..... 473/459, 473/461, 462, 465, 470, 471, 473, 474, 422, 473/446; 434/247
See application file for complete search history.

(56) References Cited

U.S. PATENT DOCUMENTS

| | | | | |
|---|---|---|---|---|
| 3,933,354 | A | 1/1976 | Goldfarb et al. | |
| 4,070,018 | A * | 1/1978 | Hodges | 473/462 |
| 4,116,437 | A | 9/1978 | Johnson | |
| 4,333,646 | A | 6/1982 | Pfeilsticker | |
| 4,401,303 | A | 8/1983 | Anderson et al. | |
| 4,461,475 | A | 7/1984 | Nakamura | |
| 4,702,475 | A * | 10/1987 | Elstein et al. | 273/445 |
| 4,718,668 | A | 1/1988 | Schipske | |
| 4,948,372 | A * | 8/1990 | Stotland | 434/247 |
| 5,498,000 | A * | 3/1996 | Cuneo | 473/471 |
| 5,527,185 | A | 6/1996 | Davis | |
| 5,709,620 | A * | 1/1998 | Reinprecht | 473/459 |
| 5,816,951 | A | 10/1998 | Hudock | |
| 5,816,953 | A | 10/1998 | Cleveland | |
| 6,135,456 | A * | 10/2000 | Cooper | 273/371 |
| 2002/0165048 | A1 | 11/2002 | Parkinson et al. | |
| 2003/0181265 | A1 * | 9/2003 | Raiss | 473/422 |

FOREIGN PATENT DOCUMENTS

| | | | |
|---|---|---|---|
| DE | 3503549 | A1 | 8/1986 |
| DE | 3616413 | A1 | 11/1987 |

(Continued)

OTHER PUBLICATIONS

Scwartz, Brett C. and Dazet, Chris A. Passing Shot Drill, "Competitive Tennis", p. 208, [online], published 1998 [retrieved on Mar. 28, 2007]. Retrieved from the internet <URL:http://books.google.com/books?vid=ISBN0880117559&id=5UdA2xzYqqoC&pg=PT180&lpg=PT180&ots=t7sQsFReNZ&dq=tennis+drills+passing+shots&sig=_B7wZtDDIfRg3QjU_KBKd_uFYYw#P>.*

*Primary Examiner*—Raleigh W. Chiu
(74) *Attorney, Agent, or Firm*—Robert L. Judd

(57) ABSTRACT

A method and apparatus for training sports skills for games including ice hockey, soccer, tennis and volleyball using one or more opponents or simulated opponents on the playing surface to train a player to strike the game object away from an opponent in addition to practicing striking the game object. A game object machine(s) can be used to project game objects to one side of the playing surface. A controller can be provided to control operation of the simulated opponent(s) and the game object machine(s) to train placement memory and reaction time in addition to muscle memory. For ice hockey and soccer, the controller can receive input from sensor(s) on the game object, player being trained or the goal to locate the game object and/or player to position the simulated opponent(s) to train the player to strike the game object past the simulated opponent into the goal.

11 Claims, 7 Drawing Sheets

FOREIGN PATENT DOCUMENTS

| | | | |
|---|---|---|---|
| DE | 3644199 | A1 | 7/1988 |
| DE | 4403424 | A1 | 3/1995 |
| JP | 1180949 | | 12/1974 |
| JP | 57131463 | | 8/1982 |
| JP | 9234263 | | 9/1997 |
| WO | WO 85/04815 | | 11/1985 |
| WO | WO 02/15992 | A2 | 2/2002 |

* cited by examiner

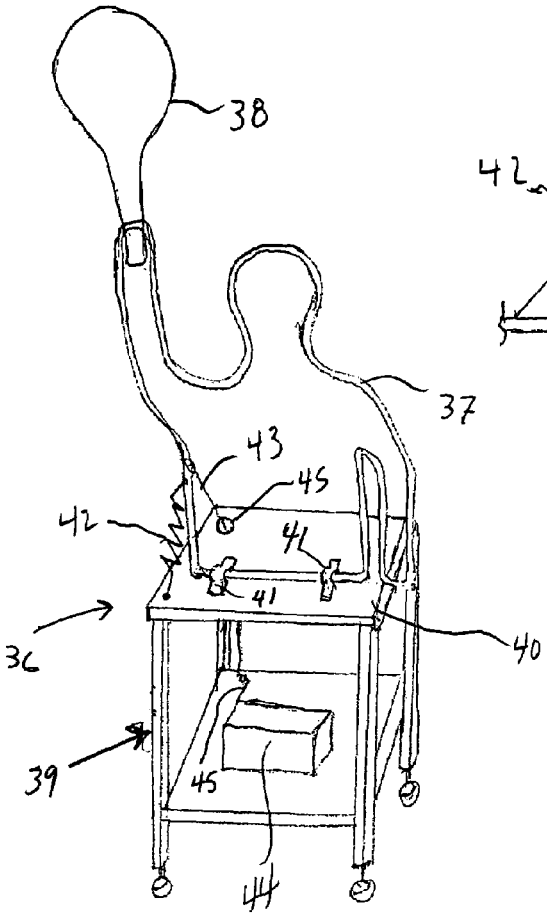
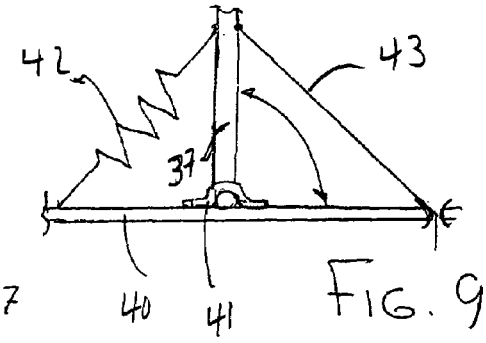
FIG. 9
FIG. 8
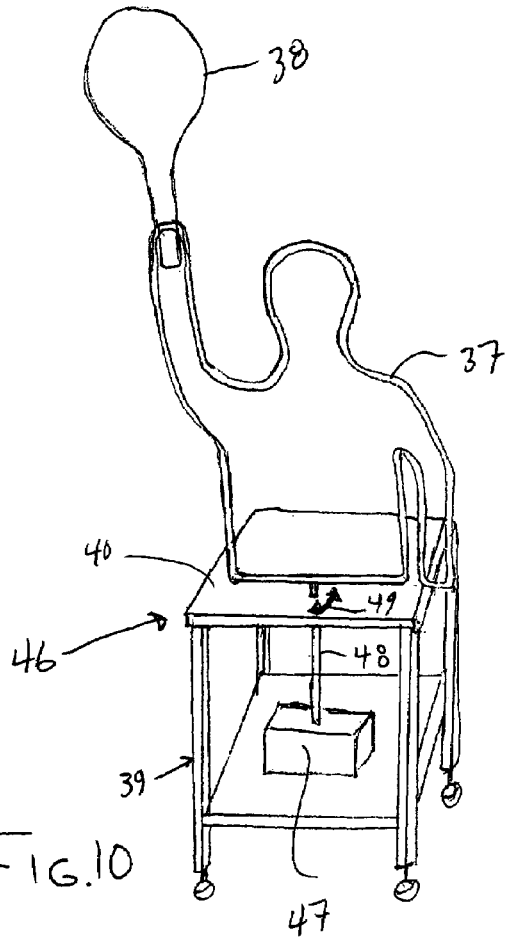
FIG. 10

SPORTS SKILLS TRAINING METHOD AND APPARATUS

BACKGROUND OF THE INVENTION

A number of sports games are conducted on a playing surface and involve a player striking a game object away from an opponent in order to be successful. Such sports games can include ice hockey, soccer, tennis and volleyball. Training methods for such sports can include a machine for projecting game objects to the side of the playing surface occupied by a player being trained so that the player being trained can practice and improve his/her skills by striking the game object. For example, tennis players often train by returning balls projected by a ball machine or hit by a trainer to their side of a tennis court to develop their ball return skills. Similarly, ice hockey, soccer and volleyball players practice by striking hockey pucks, soccer balls or volleyballs projected to their side of the game surface by a trainer or a machine. Targets and free kick walls are used in training ice hockey and soccer skills.

BRIEF DESCRIPTION OF THE DRAWINGS

FIG. 8 is a schematic perspective view of a simulated opponent according to the invention.

FIG. 9 is a partial schematic view of a hinge and biasing structure that can be used on a simulated opponent like that in FIG. 8.

FIG. 10 is a schematic perspective view of another embodiment of a simulated opponent according to the invention.

DESCRIPTION OF THE INVENTION

According to the invention, a method and apparatus for training sports skills for a game conducted on a playing surface that includes striking a game object away from an opponent can include projecting a plurality of game objects toward one portion of the playing surface, and selectively having one or more opponents appear at one or more locations on the playing surface in order to train the player to strike the game object away from an opponent. The addition of one or more opponents teaches the player being trained to strike the game object away from an opponent in addition to practicing striking the game object. In the case of games involving hitting or kicking a game object into a goal, one or more opponents can be arranged to appear at multiple locations in or in front of the goal to simulate a goalie to teach a player how to strike a game object past a goalie into the goal. The method and apparatus according to the invention can include, but need not include, projecting a plurality of game objects to the side of court occupied by the player being trained for training players to score in games involving striking or kicking a game object into a goal. For example, when method and apparatus according to the invention is applied to the game of tennis, the player being trained can be taught to play the court by training reaction time and placement memory in the brain of the player in addition to training muscle memory in returning the tennis ball. When a trainer is used to hit tennis balls to the side of the tennis court occupied by the player being trained there can be a tendency for the player being trained to hit the ball back to the trainer so that a volley can be sustained. However, training the placement memory of the player being trained to hit the tennis ball back to the trainer can be counter productive when it comes time to play a game of tennis when the object is to hit the tennis ball within the court where the opponent(s) can not return the ball. When the method and apparatus according to the invention is applied to the game of ice hockey or soccer, a simulated opponent can be arranged to act as a goalie movably mounted on, or in front of a goal to train placement memory by focusing the player being trained on striking the game object away from the goalie in addition to training muscle memory in making shots on goal.

Figure 1:
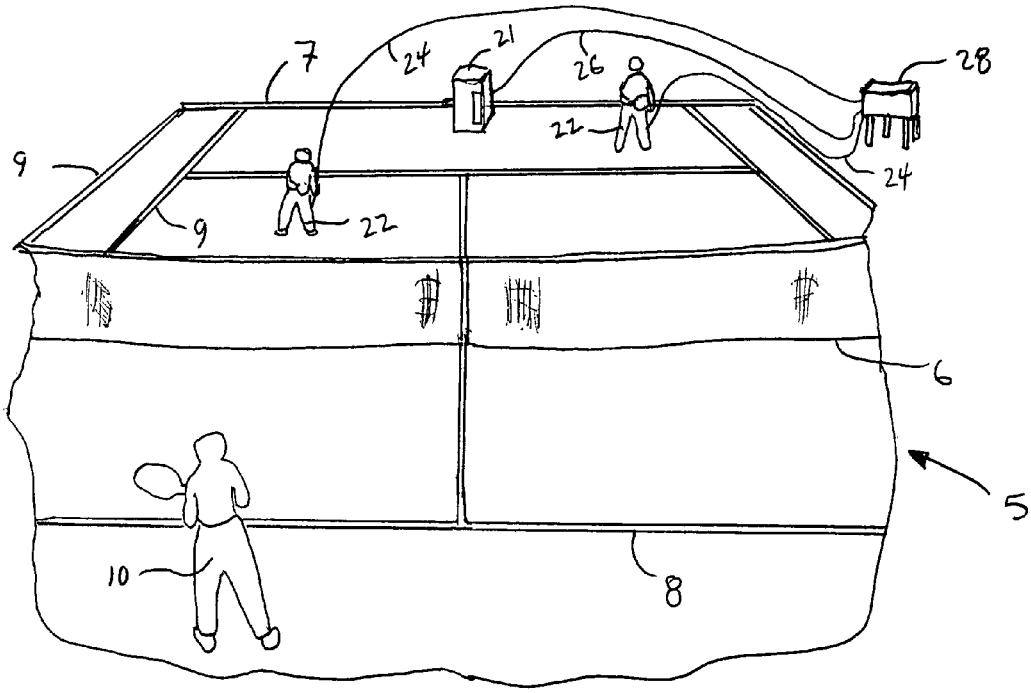
FIG. 1 is a schematic perspective view of a portion of a tennis court showing application of the sports training method and apparatus according to the invention being used to train a tennis player.
Figure 2:
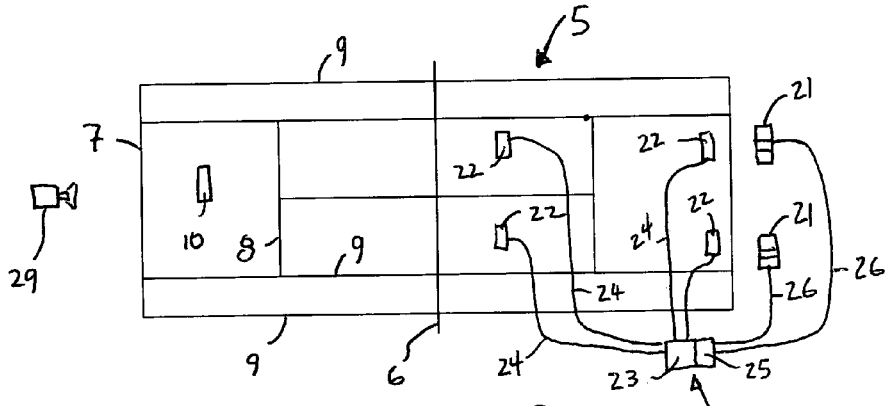
FIG. 2 is a schematic view of a tennis court showing one embodiment of the sports training method and apparatus according to the invention being used to train a tennis player.
Figure 3:
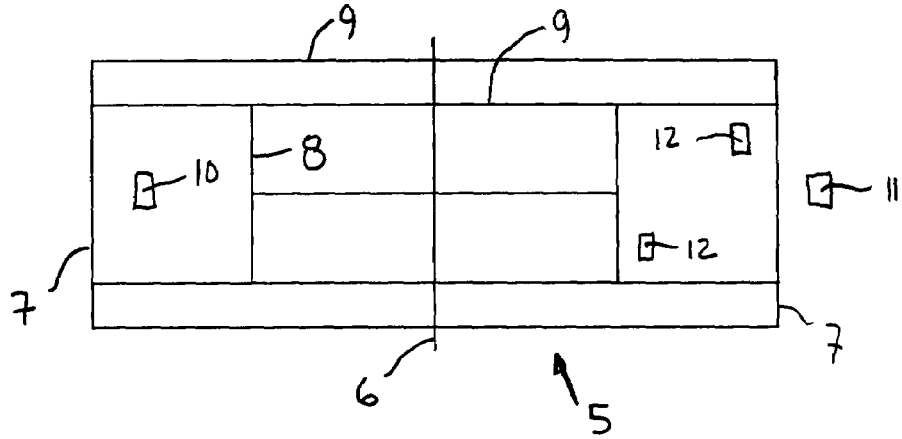
FIG. 3 is a schematic view of a tennis court showing another embodiment of the sports training method and apparatus according to the invention being used to train a tennis player.

Turning to FIG. 1 through FIG. 7, the method and apparatus for training sports skills applied to the game of tennis can be seen. Tennis court 5 can have a net 6, base lines 7, service lines 8 and side lines 9 as are well known. A player 10 being trained can be positioned on one side of tennis court 5. Referring to FIG. 3, a player 10 being trained can be positioned on one side of tennis court 5 and a trainer 11 can be positioned at the back line 7 on the opposite side of the tennis court 5. As will be described below, a ball machine can be used to project tennis balls to the side of the tennis court occupied by player 10 instead of a trainer 11. One or more opponents 12 can be positioned on the opposite side of tennis court 5 from the player being trained. Opponents 12 can be persons or can be simulated opponents that operate mechanically as described in greater detail below. Use of one or two opponents 12 can depend on whether the player is being trained in singles or doubles and can depend on whether the opponent is a person or is a simulated opponent the operates mechanically. In the embodiment of the invention as shown in FIG. 3, trainer 11 can sequentially hit a plurality of tennis balls to the side of the tennis court occupied by player 10, and can direct one or more opponents 12 to occupy selected locations on the opposite side of the tennis court so that player 10 can be trained to return the tennis balls away from the opponent(s) 12, thereby teaching tennis player 10 to play the tennis court and training placement memory in the brain of player 10 in addition to training muscle memory of player 10. Use of opponent(s) 12 arranged to occupy selected locations on the opposite side of the tennis court can also improve the reaction time of player 10 by requiring player 10 to observe the position of opponent(s) 12 and decide where to return the tennis ball. Thus, player 10 can be trained to develop muscle memory fir skills of returning tennis balls to the opposite court, and can also improve reaction time and develop placement memory in the brain, namely, observe the location of the opponent(s) and return the ball away from the opponent(s). Opponent(s) 12 can be positioned on the opposite side of tennis court 5 to simulate where a player of a selected skill level would likely be positioned in relation to the tennis ball hit by trainer ii to the side of the tennis court occupied by the player 10 being trained. For example, if trainer 11 hit a lob shot; opponent(s) 12 can be directed to the location(s) that an opponent of a selected skill level would take after hitting a lob shot. Player 10 will face a realistic situation of returning a lob shot to the opposite side of the tennis court occupied by an opponent or opponents, thus providing the opportunity to train the brain of player 10 to not only return the tennis ball hit by the trainer, but to decide in real time where to return the tennis ball, namely away from the opponents positioned on the opposite side of the tennis court 5.

Turning to FIG. 1 and FIG. 2, another embodiment of the invention, again applied to the game of tennis, can be seen. A player 10 being trained can be positioned on one side of tennis court 5. A plurality of simulated opponents 22 can be provided on the opposite side of tennis court 5. One or more ball machines 21 can be provided on the opposite side of tennis court 5. Simulated opponents 22 can be arranged to appear at selected locations on the opposite side of tennis court 5 under control of an opponent control 23. Simulated opponents 22 can be connected to opponent control 23 by control lines 24. Opponent control 23 and/or simulated opponents 22 can be provided with a suitable power source as described below. Those skilled in the art will understand that control lines 24 shown schematically in FIG. 1 and FIG. 2 can be mechanical lines to move simulated opponents 22 or can be electrical lines to operate selected ones of simulated opponents 22 to appear as will be described below. Those skilled in the art will also understand that control lines 24 can be wireless electromagnetic connections to the simulated opponents 22. While two simulated opponents 22 are shown in FIG. 1 and four simulated opponents 22 are shown in FIG. 2, the apparatus according to the invention contemplates using one or more simulated opponents 22 on the opposite side of the tennis court to simulate the play of one or two opponents in a game of tennis. The number of simulated opponents used can depend on the nature of the simulated opponent and can depend on the level of skill being trained.

One or more ball machines 21 can be provided behind base line 7 to project the plurality of tennis balls to the side of the tennis court occupied by player 10. Tennis ball machines are well known in the art and can be arranged to project tennis balls at a variety of speeds, directions, elevations and spins to simulate the play of opponents and different tennis shots. Ball machines 21 can be stationary or can be movable side to side in operation to simulate an opponent hitting tennis balls from multiple locations. In addition, a single tennis ball machine having multiple outlets can be used to simulate an opponent hitting tennis balls to the side of the tennis court occupied by player 10 from multiple locations. A game object or ball machine control 25 can be provided to control operation of ball machines 21. While one ball machine 21 is shown in FIG. 1 and two ball machines 21 are shown in FIG. 2, the method and apparatus according to the invention contemplates use of one or more than two ball machines or ball machines having multiple outlets to project tennis balls to the side of the tennis court occupied by player 10 depending on the capability of the ball machines to project tennis balls in various directions, whether movable ball machines 21 are used and the skill level be taught. Ball machines 21 can be connected to ball machine control 25 by control lines 26. Control lines 26 can be electrical lines or can be wireless electromagnetic connections as will be understood by those skilled in the art. As in the case of simulated opponents 22 and opponent control 23, ball machine(s) 21 and ball machine control 25 can be provided with a suitable power source that can include a battery, solar cell, connection to an electrical receptacle or portable generator as is well known in the art.

Opponent control 23 and game object or ball machine control 25 can be combined in a controller 28. Controller 28 can be programmed to operate ball machines 21 to sequentially project a plurality of tennis balls in selected combinations of direction, speed, elevation and spin, and to operate simulated opponents 22 to appear at selected locations on the opposite side of tennis court 5 to simulate the play of one or more tennis players having a selected skill level. Controller 28 can include a plurality of preprogrammed programs to simulate a plurality of skill levels. For example, controller 28 can be preprogrammed to simulate skills that can include grade school, high school, college, beginner, intermediate, advanced, professional, recreational, singles and doubles. Controller 28 can have a selector or selectors to set the game, i.e. singles or doubles, and the skill level. Controller 28 can also be provided with a timer to operate for a predetermined time, for example 30 minutes and can have a mechanism for processing payment by coin, currency or card. Controller 28 can be provided with a so-called smart card reader that can read the skill level programmed into the card and deduct payment from the card. A video recorder 29, see FIG. 2, can be provided to document the performance of the player 10 being trained to show the player how the player is striking the tennis ball, or to document improvement over time as is well known in the art. Video recorder 29 can be connected to controller 28 to control operation of the video recorder as is well known in the art. Controller 28 and video recorder 29 can be provided with a suitable power source that can include a battery, a solar cell, connection to an electrical receptacle or a portable generator, or other known power sources. A video recorder can be provided for any of the embodiments described in this application.

The embodiments of FIG. 1 and FIG. 2 can operate the method for training tennis skills as described above in connection with FIG. 3. Controller 28 can be arranged to simulate a selected skill level as described above. For each tennis ball projected by the ball machine(s) under control of ball machine control 25, opponent control 23 can cause one or more of the simulated opponents 22 to appear at one or more selected locations on the opposite side of tennis court 5. As in the embodiment of FIG. 3, the location or locations at which a simulated opponent or opponents 22 appear can depend on kind of shot the ball machine 21 is simulating (i.e. a serve, a lob shot, a cross court shot, etc.) and the selected skill level of the simulated opponent(s) 22. As in the case of the embodiment shown in FIG. 3, player 10 will face a realistic situation of returning a shot to the opposite side of the tennis court occupied by an opponent or opponents. Thus, the sports skills training method and apparatus of FIG. 1 and FIG. 2 provides mental exercise and the opportunity to train the brain of player 10 to not only return the tennis ball hit by the ball machine (muscle memory), but to decide in real time (reaction time) where to return the tennis ball, namely away from the opponents positioned on the opposite side of the tennis court 5 (placement memory).

Figure 3A:
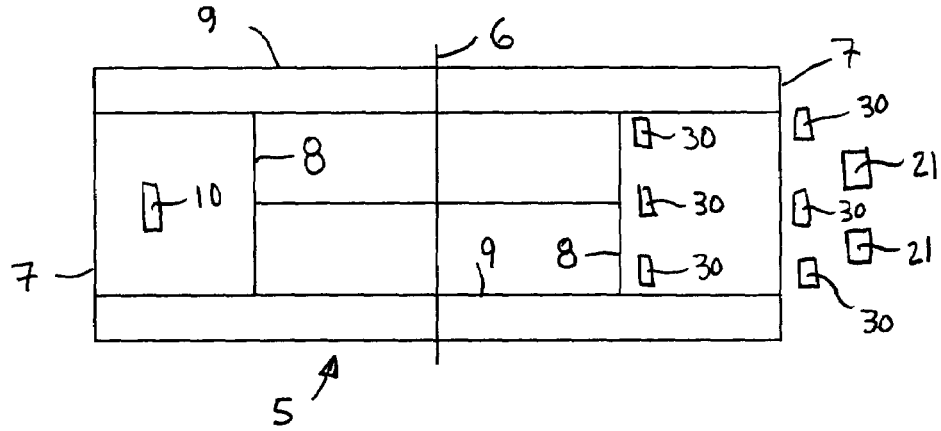
FIG. 3A is a schematic view of a tennis court showing another embodiment of the sports training method and apparatus according to the invention being used to train a tennis player.

Turning to FIG. 3A, another embodiment of the sports skills training method and apparatus for training tennis skills can be seen. In the embodiment of FIG. 3A a plurality of ball machines 21 can be provided along base line 7 of the opposite side of tennis court 5 from player 10 being trained. While two ball machines are shown in FIG. 3A, one or more ball machines can be used as discussed above depending on the capabilities of the ball machines and the skill level to be simulated. A plurality of stationary simulated opponents 30 can be provided on the opposite side of tennis court 5. In the embodiment of FIG. 3A three simulated opponents 30 are positioned along service line 8 and three simulated opponents 30 are positioned along base line 7. While six simulated stationary opponents 30 are shown in FIG. 3A, it is to be understood that any number of stationary simulated opponents can be used in the practice of the method and apparatus for training sports skills according to the invention. One or more simulated opponents, including more than six simulated opponents can be used depending on the nature of the simulated opponents and the skill level to be simulated. Stationary simulated opponents 30 can be positioned on court 5 to simulate typical locations occupied by a tennis player having a selected skill level. The stationary simulated opponents 30 can be arranged to appear at the location in which they are respectively positioned when respective ones of the stationary simulated opponents are activated by a simulated opponent control, not shown, as described above in connection with the embodiments shown in FIG. 1 and FIG. 2. Stationary simulated opponents 30 can take a number of forms and can be provided with a suitable power source, examples of which are described below. In operation the embodiment of FIG. 3A can be like the embodiments of FIG. 1 and FIG. 2. One or more of stationary simulated opponents 30 can be activated by an opponent control, not shown, to appear at a selected location in response to one of ball machines 21 projecting a tennis ball toward player 10 being trained. As described above, player 10 will face a realistic situation of returning a shot to the opposite side of the tennis court occupied by an opponent or opponents. Thus the sports skills training method and apparatus of FIG. 3A provides the opportunity to train the brain of player 10 to not only return the tennis ball hit by the ball machine (muscle memory), but to decide in real time (reaction time) where to return the tennis ball, namely away from the opponents positioned on the opposite side of the tennis court 5 (placement memory).

Figure 4:
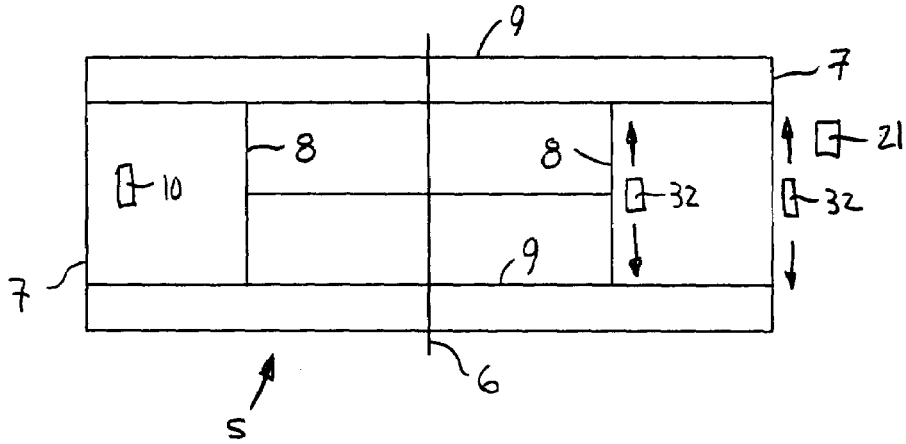
FIG. 4 is a schematic view of a tennis court showing another embodiment of the sports training method and apparatus according to the invention being used to train a tennis player.
Figure 11:
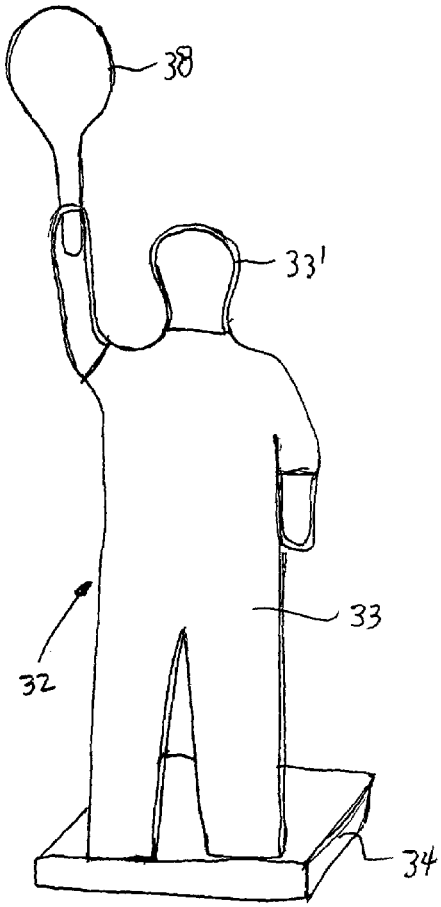
FIG. 11 is a schematic perspective view of another embodiment of a simulated opponent according to the invention.

Turning to FIG. 4, another embodiment of the sports skills training method and apparatus for training tennis skills can be seen. In the embodiment of FIG. 4 a ball machine 21 can be provided along base line 7 of the opposite side of tennis court 5 from player 10 being trained. Ball machine 21 can be stationary or can be mounted on wheels or a track to be movable side to side in operation along base line 7 depending on the capability of the ball machine used to project tennis balls in a variety of directions and the skill level to be simulated. Ball machines movable side to side in operation can be used in other embodiments as will be readily understood by those skilled in the art. Ball machine 21 can be provided with more than one outlet to project tennis balls from more than one location to simulate an opponent hitting tennis balls from multiple locations or to simulate two opponents. While a single ball machine is shown in this embodiment, those skilled in the art will appreciate that two or more ball machines can be provided depending on the capability of the ball machine and the level of skill to be simulated. Two movable simulated opponents 32 can be provided on the opposite side of tennis court 5. In the embodiment of FIG. 4, movable simulated opponents 32 can be arranged to move side to side on tennis court 5, one simulated opponent 32 along service line 8 and the other simulated opponent 32 along base line 7. While the simulated opponents are shown movably positioned along the service line 8 and base line 7, the method and apparatus for training sports skills contemplates movably locating the simulated opponents at any position on tennis court 5 to simulate the play of a selected skill level as described above. Movable simulated opponents 32 can include a simulated tennis player mounted on a base that is movable side to side on tennis court 5. FIG. 11 discloses an example of a movable simulated opponent 32 that can include a simulated tennis player 33 mounted on a base 34. Base 34 can be mounted on wheels, not shown, to allow base 34 to move side to side on tennis court 5. Base 34 can be propelled by a motor driven wheel or can be moved back and forth across tennis court 5 by a cable. Simulated opponent 32 can be arranged to be movable in other ways in addition to the examples mentioned in the previous sentence as will be readily understood by those skilled in the art. Movable simulated opponents 32 can be controlled by an opponent control, not shown, to move to selected locations side to side on tennis court 5 in connection with projection of a tennis ball by ball machine 21 to simulate the position a tennis player or players would assume in response to the ball projected by the ball machine as in the case of the embodiments of FIG. 1 and FIG. 2 described above. Simulated opponents 32 can have a suitable power source as described below. A control for ball machine 21, not shown, and an opponent control, not shown, can be incorporated in a controller, not shown, all as described above.

Figure 5:
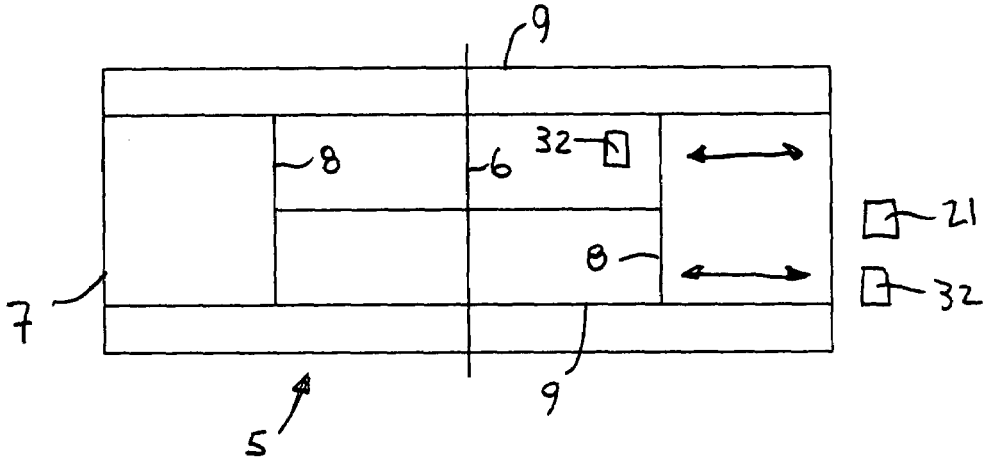
FIG. 5 is a schematic view of a tennis court showing another embodiment of the sports training apparatus according to the invention being used to train a tennis player.

Turning to FIG. 5, another embodiment of the sports skills training method and apparatus for training tennis skills can be seen. In the embodiment of FIG. 5 a ball machine 21 can be provided along base line 7 of the opposite side of tennis court 5 from player 10 being trained. Ball machine 21 can be stationary or can be mounted on wheels or a track to be movable side to side in operation along base line 7 depending on the capability of the ball machine used to project tennis balls in a variety of directions and the skill level to be simulated. While a single ball machine is shown in this embodiment, those skilled in the art will appreciate that two or more ball machines, or a ball machine with multiple outlets can be provided depending on the capability of the ball machine and the level of skill to be simulated. Two movable simulated opponents 32 can be provided on the opposite side of tennis court 5. In the embodiment of FIG. 5, movable simulated opponents 32 can be arranged to move front to back on tennis court 5, one simulated opponent 32 moving on one side of tennis court 5 and the other simulated opponent moving on the other side of tennis court 5. Simulated opponents 32 can be arranged to move from a position between service line 8 and net 6 to a position outside base line 7. It should be understood that the range of movement of simulated opponents 32 can be controlled by an opponent control, not shown, and can be selected to simulate the range of a player of a selected skill level. As in the embodiment of FIG. 4, simulated opponent 32 can be a simulated opponent as disclosed in FIG. 11 and can be mounted on a base 34 that is movable and can be provided with a power source as described below.

Figure 6:
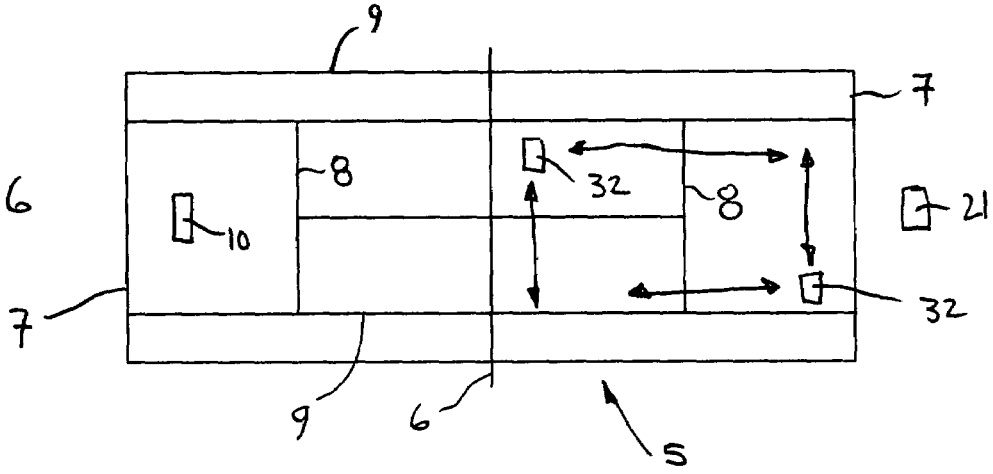
FIG. 6 is a schematic view of a tennis court showing another embodiment of the sports training apparatus according to the invention being used to train a tennis player.

Turning to FIG. 6, another embodiment of the sports skills training method and apparatus for training tennis skills can be seen. In the embodiment of FIG. 6 a ball machine 21 can be provided along base line 7 of the opposite side of tennis court 5 from player 10 being trained. Ball machine 21 can be stationary or can be mounted on wheels or a track to be movable side to side in operation along base line 7 depending on the capability of the ball machine used to project tennis balls in a variety of directions and the skill level to be simulated. While a single ball machine is shown in this embodiment, those skilled in the art will appreciate that two or more ball machines, or a ball machine with multiple outlets can be provided depending on the capability of the ball machine and the level of skill to be simulated. Two movable simulated opponents 32 can be provided on the opposite side of tennis court 5. In the embodiment of FIG. 6, movable simulated opponents 32 can be arranged to move in any direction on tennis court 5. Movable simulated opponents 32 can be arranged to move front to back and side to side as illustrated by direction arrows 35, or simulated opponents can be arranged to be freely movable in any direction on tennis court 5. Simulated opponents 32 can be a simulated opponent as disclosed in FIG. 11 and operate as described above in connection with FIG. 4 and FIG. 5. Simulated opponents 32 that can move freely in any direction on tennis court 5 can include a base 34 comprising a robot movable in any direction under direction of an opponent control, not shown, incorporated in a controller, not shown. As in the case of the embodiments shown in FIG. 4 and FIG. 5, the movable simulated opponents 32 in FIG. 6 can be controlled by an opponent control, not shown, to move to selected locations on tennis court 5 in connection with projection of a tennis ball by ball machine 21 to simulate the position a tennis player or players would assume in response to the ball projected by the ball machine as in the case of the embodiments of FIG. 1 and FIG. 2 described above. As in the embodiments of FIG. 4 and FIG. 5, simulated opponents 32 can be provided with a power source as described below.

Figure 7:
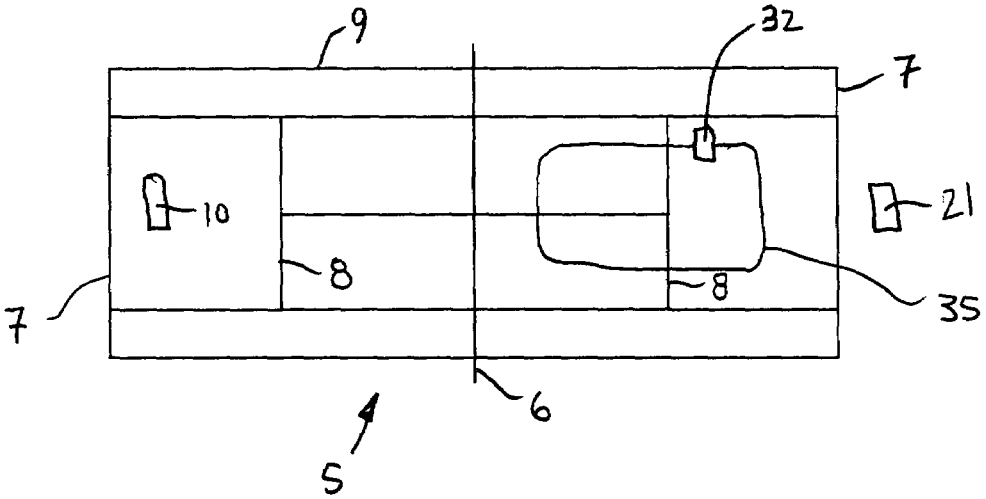
FIG. 7 is a schematic view of a tennis court showing another embodiment of the sports training apparatus according to the invention being used to train a tennis player.

Turning to FIG. 7, another embodiment of the sports skills training method and apparatus for training tennis skills can be seen. In the embodiment of FIG. 7 a ball machine 21 can be provided along base line 7 of the opposite side of tennis court 5 from player 10 being trained. Ball machine 21 can be stationary or can be mounted on wheels or a track to be movable side to side in operation along base line 7 depending on the capability of the ball machine used to project tennis balls in a variety of directions and the skill level to be simulated. While a single ball machine is shown in this embodiment, those skilled in the art will appreciate that two or more ball machines, or a ball machine with multiple outlets can be provided depending on the capability of the ball machine and the level of skill to be simulated. A movable simulated opponent 32 can be provided on the opposite side of tennis court 5 from the player 10 being trained. Simulated opponent 32 can be arranged to travel on, or follow track 35 provide on the opposite side of tennis court 5. Track 35 can be a mechanical track or guide for simulated opponent 32 to follow as is well known in the art. Alternately, track 35 can be a wire or tape for simulated opponent 32 to follow using optical or electromagnetic sensors for following track 35, again as well known in the art. Simulated opponent 32 can be controlled by an opponent control to move to selected locations along track 35 on tennis court 5 in connection with projection of a tennis ball by ball machine 21 to simulate the position a tennis player or players would assume in response to the ball projected by the ball machine as in the case of the embodiments of FIG. 1 and FIG. 2 described above. Simulated opponents 32 can be provided with a suitable power source as described below. A control for ball machine 21, not shown, and an opponent control, not shown, can be incorporated in a controller, not shown, all as described above. While track 35 is shown in FIG. 7 as a generally rectangular track, those skilled in the art will recognize that track 35 can assume any desired shape in order to facilitate location of simulated opponent 32 is desired locations on tennis court 5 in order to simulate a player of selected skill level(s). Likewise, track 35 need not be confined to the bounds of tennis court 5 defined by side lines 9 and base line 7 as often tennis players move outside the lines of a tennis court in returning a tennis ball.

A number of simulated opponent embodiments can be seen in FIG. 8 through FIG. 15. While the simulated opponents are shown in FIG. 8 through FIG. 15 in a shape simulating a tennis player holding a racket, it should be understood that the simulated players could be formed to simulate an opponent for the sports game to be simulated. Turning to FIG. 8 and FIG. 9, a folding simulated opponent 36 can be seen. Simulated opponent 36 can have a wire form frame 37 representing the upper body of a tennis player. Wire form frame 37 can include the outline of a head and two arms; one raised and arranged to hold a tennis racket shaped form 38. Wire form frame 37 can be pivotally mounted to a base unit schematically represented as a cart 39 having a mounting surface 40. Wire form 37 can be pivotally mounted to mounting surface 40 by clips 41 engaging wire form 37 and fastened to mounting surface 40 by fasteners, not shown. Wire form frame 37 can be held in a vertical position by a spring 42 and cable 43. Cable 43 can be operated by control 44 that can include a crank 45 arranged to pull cable 43 through an opening 45 in mounting surface 40. With crank 45 in the position shown in FIG. 8 and FIG. 9, wire form frame 37 can be in the vertical position. When control 44 is activated, crank 45 can rotate pulling on cable 43 and thereby pivoting wire form frame 37 to a substantially horizontal position. When control 44 is deactivated, spring 42 can rotate wire form frame 37 back to the vertical position, thus causing the simulated opponent to appear. Control 44, and any mechanism to move cart 39, can be powered by a battery, solar cell or by connection to a power source that could be an electrical receptacle or a portable generator as will by understood by those skilled in the art.

Wire form frame 37 can have a suitable cover decorated to simulate a tennis player's face and body. Likewise, tennis racket portion 38 can be covered to simulate a tennis racket. Cart 39 can have resilient feet on the ends of the legs contacting tennis court 5, or can be provided with wheels, rollers or casters to facilitate movement of cart 39 to selected positions on a tennis court. While cart 39 is shown in FIG. 8 as a manually movable cart, it should be understood that cart 39 can be provided with a mechanism to move cart to selected positions on a tennis court as discussed in connection with FIG. 1 through FIG. 7 above. While a spring and cable mechanism is shown in FIG. 8 and FIG. 9 to operate simulated opponent 36, it should be understood that any suitable mechanism can be used to rotate wire form frame 37 between a vertical position in which the simulated opponent appears and a substantially horizontal position where the simulated opponent is "not present". For example opposed springs or opposed cables and suitable operators could be used. Similarly, electromagnetic, pneumatic or hydraulic operators could be used to activate and deactivate the simulated opponent 36. The simulated opponent 36 can be made of material other than a wire form 37. The simulated opponent could be a foam board or other light weight, perforate or imperforate strong sheet material cut out in the form of a tennis player holding a tennis racket suitably hinged to mounting surface 40. Instead of being hinged to rotate front to back, wire form frame 37 can be hinged to tip to the side when "not present" and tip back to the upright position to appear. When wire form frame 37 is hinged to tip to the side, the operating arrangement can be adjusted accordingly as will be readily understood by those skilled in the art. Simulated opponent 36 can also be a full height figure rather than a half body figure as shown in FIG. 8, or the figure can be hinged in the middle allowing the top portion to fold to a substantially horizontal position while allowing the bottom portion to remain vertical. In the case of a full height figure, the mounting surface can be lower to the tennis court than shown in FIG. 8. An advantage of a half body form as in FIG. 8 is that the height of the simulated opponent from the pivot point is less than for a full figure thereby reducing the force and time need to move the simulated figure to a vertical position and back to a folded or substantially horizontal position. It should be understood that the sports training method and apparatus according to the invention includes a full or partial form simulating an opponent.

Turning to FIG. 10, another embodiment of a simulated opponent can be seen. In the embodiment of FIG. 10, pivoting simulated opponent 46 can include a wire form frame 37 pivotally mounted to a base unit schematically illustrated as a cart 39 like the cart in FIG. 8. Cart 39 can include a mounting surface 40 that can have a shaft 48 projecting through the mounting surface for rotatably carrying wire form frame 37. Shaft 48 can extend to operator 47 that can be arranged to rotate shaft 48, as shown by rotation arrow 49, between a position with wire form frame 37 facing the player 10 being trained on court 5, not shown in this figure, and a position facing the side lines 9 of tennis court 5, not shown in this figure. Operator 47, and any mechanism to move cart 39, can be powered by a battery, solar cell or connection to a power source as described above in the embodiment of FIG. 8. When wire form frame 37 is positioned facing player 10, the simulated opponent appears as an opponent for player 10 to avoid in returning the tennis ball projected to the side of the tennis court occupied by player 10 as described above. When wire form frame 37 is rotated facing the side lines 9, the simulated opponent is "not present". For example, the mechanism to operate shaft 48 can be a well known target positioning apparatus as used in rifle ranges. Simulated opponent 46 can be used in the embodiments of FIG. 1 through FIG. 7 as discussed above. Like the embodiment of FIG. 8, cart 39 can be stationary or movable. Cart 39 can be manually movable or can be movable under control of a control or controller to simulated movement of a tennis player having a selected skill level. The simulated opponent can be a foam board or other light weight, strong perforate or imperforate sheet material cut out in the form of a tennis player holding a tennis racket suitably attached to shaft 48. Likewise, as in the case of the embodiment shown in FIG. 8, the simulated opponent can simulate a full body as opposed to the half body form shown in FIG. 10.

Turning to FIG. 11, another embodiment of a simulated opponent can be seen. In the embodiment of FIG. 11, a simulated opponent 32 can include a wire form frame 33' mounted to a base unit 34. Wire form frame 33' can include a tennis racket portion 38. Simulated opponent 33 can be a cloth or other covering decorated to appear to be a tennis player carried on wire form frame 33'. As described above, base 34 can be movably positionable on tennis court 5 to permit simulated opponent 33 to appear at selected locations on tennis court 5. As in case of the embodiments shown in FIG. 8 and FIG. 10, the simulated opponent can be formed of any desired material such as foam board, light, resilient sheet material that can be perforate or imperforate and the like instead of a wire form covered with a cloth or other perforate or imperforate sheet like material. Simulated opponent 32 can also be arranged to be a stationary opponent as described in the embodiment of FIG. 3A. Simulated opponent 32 can be used in the same manner as the embodiments previously described in the practice of the sports skills training method according to the invention. Simulated opponent 32 can be provided without a base when intended for use as a stationary simulated opponent depending on the construction of the simulated opponent 32. When simulated opponent 32 and/or base 34 are arranged to be movable, a suitable power source as described in connection with the embodiments of FIG. 8 and FIG. 10 can be provided.

Figure 12:
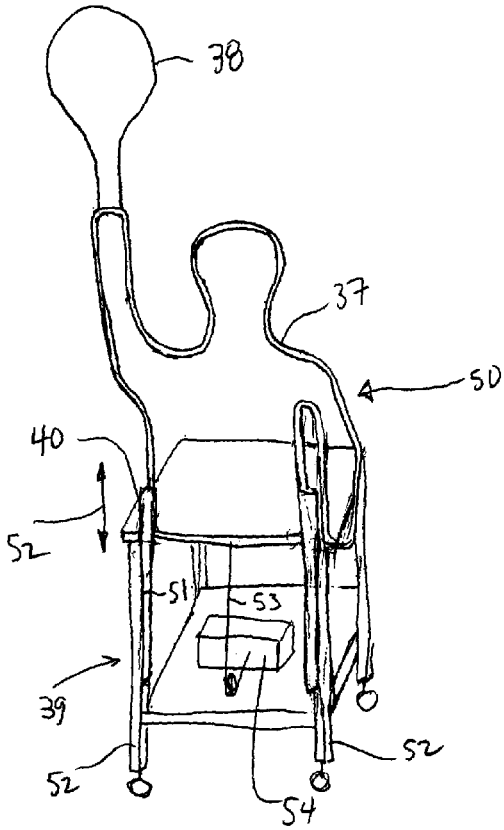
FIG. 12 is a schematic perspective view of another embodiment of a simulated opponent according to the invention.

Turning to FIG. 12, another embodiment of a simulated opponent can be seen. In the embodiment of FIG. 12, a vertically movable, or telescoping simulated opponent 50 can include a wire form frame 37 slidably carried on a base unit schematically illustrated as a cart 39 like the cart in FIG. 8. Cart 39 can include a mounting surface 40 and a pair of channels 51 associated with legs 52 for slidably supporting a wire form frame 37. Portions of wire form frame 37 can be captured in channels 51 to hold the wire form frame in a generally vertical plane on the front of cart 39. Alternately, wire form frame 37 can have a plurality of projections extending horizontally outwardly for engaging channels 51 to guide wire form frame 37 for vertical motion as shown by direction arrow 52. A cable 53 can be attached to wire form frame 37 to draw wire form frame 37 downward to render simulated opponent 50 "not present" against the tension of a spring, not shown, by operator 54. When operator 54 releases cable 53, wire form frame 37 can pop up causing simulated opponent 50 to appear. Like the embodiments of FIG. 8 and FIG. 10, operator 54 and/or cart 39 can be provided with a power source that can include a battery, a solar cell or connection to a power source that can include and outdoor receptacle or portable generator, or other power sources well known in the art. Other well known actuating mechanisms can be used to move wire form frame 37 between the exposed position (as shown in FIG. 12) and a "not present" position in front of cart 39. Simulated opponent 46 can be used in the embodiments of FIG. 1 through FIG. 7 as discussed above. Like the embodiment of FIG. 8, cart 39 can be stationary or movable. Cart 39 can be manually movable or can be movably positionable under control of a control or controller to simulated movement of a tennis player having a selected skill level. Simulated opponent 50 can be a foam board or other light weight, strong perforate or imperforate sheet material cut out in the form of a tennis player holding a tennis racket instead of a wire form frame having a suitable cloth or similar covering decorated to appear as a tennis player.

Figure 13:
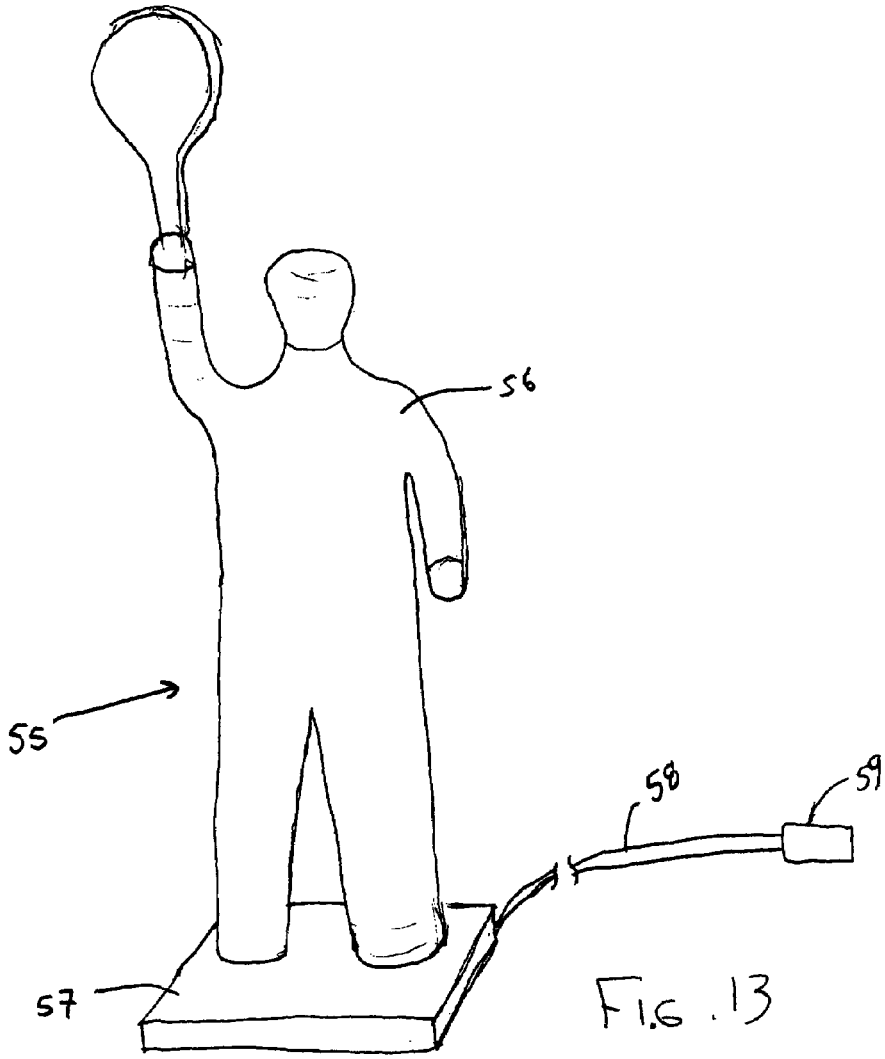
FIG. 13 is a schematic perspective view of another embodiment of a simulated opponent according to the invention.
Figure 14:
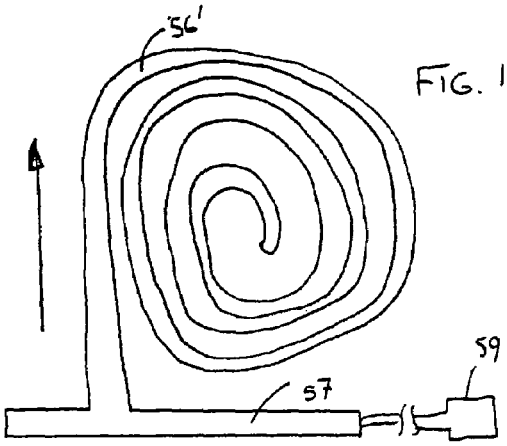
FIG. 14 is a schematic side view of a simulated opponent like that in FIG. 13 in a coiled condition.
Figure 15:
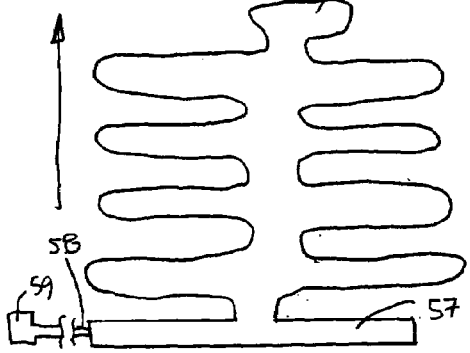
FIG. 15 is a schematic side view of a simulated opponent like that in FIG. 13 in a collapsed condition.

Turning to FIG. 13 to FIG. 15 another embodiment of a simulated opponent can be seen. In the embodiments of FIG. 13 to FIG. 15 the simulated opponent can be inflatable to simulate a tennis player. Simulated opponent 55 can comprise an inflatable character 56 in the shape of a tennis player or a suitable opponent for other games described herein. For example, character 56 can be a vinyl or mylar material that can be light weight and strong. Character 56 can be mounted to a base 57 to hold simulated opponent 55 in a selected position on tennis court 5. A flexible hose 58 can connect base 57 and character 56 to a compressor or compressed gas source 59. Base 57 can include a suitable valve and control mechanism to control inflation of character 56 in order for simulated opponent 55 to appear on a tennis court. Compressor or compressed gas source 59 can be mounted on base 57, or can be positioned on the courting or out of the game area. Character 56 may take the form of a resilient coil 56', see FIG. 14, when deflated. Resilient coil 56' can be inflated to uncoil so that character 56 can stand erect as shown in FIG. 13. Character 56 can also take the form of a bellows 56" as shown in FIG. 15. Bellows 56" can be inflated to expand upwardly so that character 56 can stand erect as shown in FIG. 13. Inflatable character 56 can take other forms than the resilient coil 56' or bellows 56" shown in FIG. 14 and FIG. 15 as will be readily understood by those skilled in the art. Base 57 can be provided with a suitable power source as described in the embodiments of FIG. 8 and FIG. 10 to provide power to the valve and control mechanism, and if provided on base 57 a compressor and/or mechanism for moving base 57 on the tennis court. As described above, base 57 can be movably positionable on tennis court 5 to permit simulated opponent 33 to appear at selected locations on tennis court 5. Simulated opponent 55 can also be arranged to be a stationary opponent as described in the embodiment of FIG. 3A. Simulated opponent 55 can be used in the same manner as the embodiments previously described in the practice of the sports skills training method according to the invention.

Figure 16:
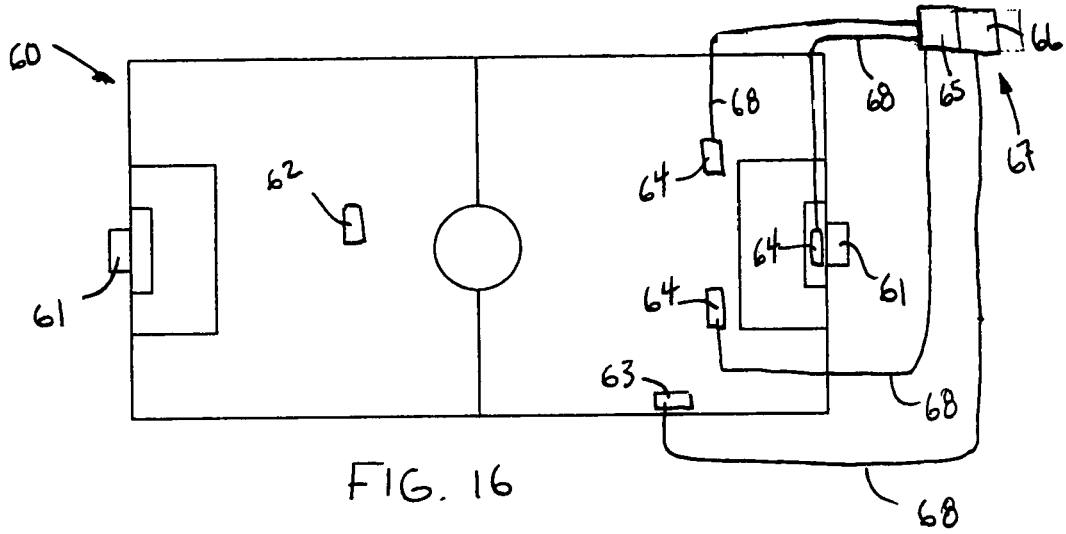
FIG. 16 is a schematic view of a soccer field showing application of sports training method and apparatus according to the invention being used to train a soccer player.

Turning to FIG. 16, application of the method and apparatus for training sports skills according to the invention to the game of soccer can be seen. In FIG. 16 a schematic soccer field 60 can include a pair of goals 61. A soccer player 62 being trained can be positioned on soccer field 60 depending on the type of shot player 62 will be practicing. While one soccer player 62 being trained is shown in FIG. 16, it should be understood that two or more players could be trained together according to the method and apparatus of the present invention since passing a soccer ball between players is an important skill in the game of soccer. One or two ball machines 63 can be provided along the sidelines of the soccer field toward one end of soccer field 60. While two ball machines are shown in FIG. 16, the training method and apparatus according to the invention contemplates training without the use of a ball machine for training a player to improve scoring skills and also the use of one or more ball machines for training a player. A simulated opponent 64 can simulate a goalie and be located in front of goal 61 at one end of soccer field 60. A simulated goalie opponent 64 can be movably mounted on goal 61, on a track in front of goal 61 or otherwise arranged to be selectively positioned in front of goal 61. For training scoring skills simulated opponent 64 can be movable laterally in front of goal 61. Similarly, a plurality of simulated opponents 64 can be provided in the vicinity of one goal 61 at the end of soccer field 60 where ball machines 63 can be positioned when used. While one simulated opponent 64 is shown in FIG. 16, two or more simulated opponents can be provided.

Simulated opponents 64 can be similar to the simulated opponents described in FIG. 8 through FIG. 15 except that the configuration of the opponent can be modified to simulate the form and appearance of a soccer player and can be further modified to eliminate a tennis racket. Ball machines 63 can have a ball machine control 66 to control operation of the ball machines to project a plurality of soccer balls to the side of the soccer field occupied by soccer player 62. Simulated opponents 64 can be provided with an opponent controller 65 to control the activation and location of simulated opponents 64. A suitable sensor(s), not shown, can be provided on the soccer ball, the soccer player 62, the goal 61 or elsewhere to track the location of the soccer ball and/or the soccer player 62 as the soccer player approaches goal 61. Opponent controller 65 can receive signals from the sensor or sensors to control the location of simulated opponent 64 in front of the goal 61, and any other simulated opponent(s) 64 used, to simulate the response of a goalie and any other defenders to defend against a possible shot by the soccer player 62. Those skilled in the art will understand that control lines 68 shown schematically in FIG. 16 can be mechanical lines to move simulated opponent(s) 64 or can be electrical lines or wireless electromagnetic communication links to operate selected ones of simulated opponent(s) 64 to appear as described above. Control lines 68 can also link ball machines 63 to ball machine control 66. Opponent controller 65 and ball machine controller 66 can be combined in a soccer controller 67 that can function in a like manner as the tennis controller 28 as described above. Soccer player 62 can move toward goal 61 handling a soccer ball in preparation for attempting to kick the soccer ball into the goal 61. As the soccer player approaches goal 61 with a soccer ball, opponent controller 65 can cause simulated opponent 64 to move in response to position of the soccer ball and/or soccer player 62 as determined by sensor(s), not shown, thus training the soccer player to focus on the goal 61 and the simulated opponent 64 and to kick the soccer ball away from simulated defender 64 into the goal 61. When used, ball machine control 66 can cause a ball machine 63 to project a soccer ball to the side of the soccer field occupied by player 62 and opponent control 65 can activate and/or move simulated opponent(s) 64 to defend goal 61 consistent with the movement of the soccer ball and/or the soccer player 62 and with an opponent having as selected skill level and the trajectory, force and direction of the soccer ball projected to the side of the soccer field occupied by the soccer player 62 being trained. As in the case of tennis, application of the method and apparatus for training sports skills for training soccer skills not only builds muscle memory in repetition of kicking or otherwise handling balls projected by the ball machine(s), the presence of simulated defenders provides the opportunity to provide reaction time and placement memory training in the brain of the soccer player 62 in attempting to kick goals to score.

Figure 17:
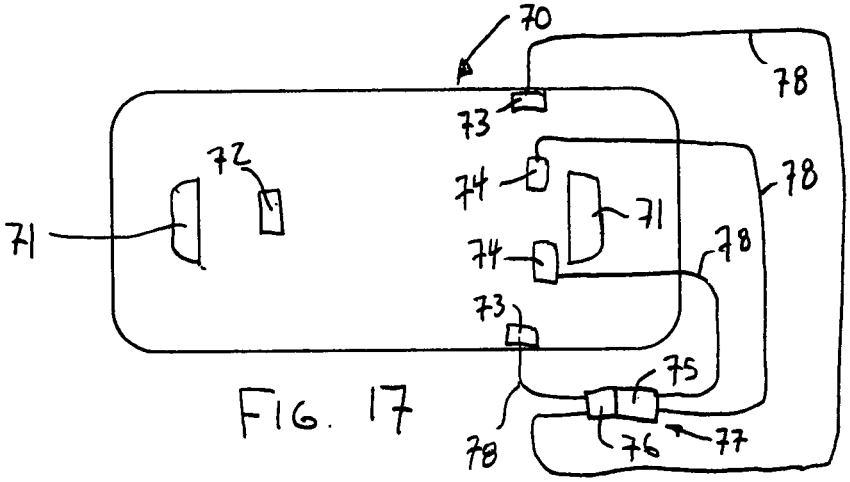
FIG. 17 is a schematic view of a hockey rink showing application of sports training method and apparatus according to the invention being used to train a hockey player.

Turning to FIG. 17 application of the method and apparatus for training sports skills according to the invention to the game of ice hockey can be seen. In FIG. 17 a schematic hockey rink 70 can include a pair of goals 71. A hockey player 72 being trained can be positioned on hockey rink 70 depending on the type of shot player 72 will be practicing. As in the embodiment of FIG. 16, more than one hockey player 72 can be trained together according to the method and apparatus of the present invention since, as in the game of soccer, passing and handling a hockey puck is an important skill in the game of hockey. One or two puck passing or puck shooting machines 73 can be provided along the sidelines of the hockey rink to project hockey pucks toward one end of the ice rink 70. Puck passing or puck shooting machines are well known in the art. While two puck machines are shown in FIG. 17, the training method and apparatus according to the invention contemplates training without the use of a puck passing or puck shooting machine for training a player to improve scoring skills and also the use of one or more puck machines for training a player to improve puck handling and defending skills as well as scoring skills. A simulated opponent 74 can simulate a goalie and be located in front of goal 71 at one end of hockey rink 70. For training scoring skills simulated opponent 74 can be movable laterally in front of goal 71. Similarly, a plurality of simulated opponents 74 can be provided in the vicinity of one goal 71 at the end of hockey rink 70 where puck machines 73 are positioned, when used. While one simulated opponent 74 in addition to a goalie is shown in FIG. 17, two or more simulated opponents can be provided.

Simulated opponents 74 can be similar to the simulated opponents described in FIG. 8 through FIG. 15 except that the configuration of the opponents can be modified to simulate the form and appearance of a hockey player or goalie and can be further modified to include a hockey stick. A simulated opponent 74 can be movably mounted to the frame of goal 71, on a track, not shown, in front of net 71 or can be mechanically or electromagnetically controlled to move in front of net 71 to simulate the play of a goalie. When additional simulated opponents 74 are provided to simulate defenders in addition to a goalie, such additional simulated opponents can be arranged to appear at selected locations as described above in previous embodiments. Puck machines 73 can have a machine control 76 to control operation of the machines to project a plurality of hockey pucks to the side of the hockey rink occupied by hockey player 72. Simulated opponents 74 can be provided with an opponent controller 75 to control the activation and location of simulated opponents 74. Simulated opponents 74 and/or opponent controller 75 can be provided with a suitable power source as described in the embodiments of FIG. 8 and FIG. 10. Those skilled in the art will understand that control lines 78 shown schematically in FIG. 17 can be mechanical lines to move simulated opponents 74 or can be electrical lines to operate selected ones of simulated opponents 74 to appear as described above. Those skilled in the art will also understand that control lines 78 can be wireless electromagnetic connections to the simulated opponents 74 and puck machines 73. Control lines 78 can also connect puck machines 73 to puck machine controller 76. A suitable sensor(s), not shown, can be provided on the puck, the hockey player 72, the goal 71 or elsewhere to track the location of the hockey puck and/or hockey player 72 as the hockey player 72 approaches net 71 with the hockey puck. Opponent controller 75 can receive signals from the sensor or sensors to control the location of simulated opponent 74 in front of the net 71 to simulate the response of a goalie to defend against a possible shot on goal by the hockey player 72. Opponent controller 75 and puck machine controller 76 can be combined in a hockey controller 77 that can function in a like manner as the tennis controller 28 as described above. Hockey controller 77 including opponent controller 75 and puck machine controller 77 can be located on goal 71 or can be located outside the hockey rink as will understood by those skilled in the art. Hockey player 72 can skate toward goal 71 handling a hockey puck in preparation for attempting to strike the hockey puck into the goal 71 with the hockey stick. As the hockey player approaches goal 71 with a hockey puck, opponent controller 75 can cause simulated opponent 74 to move side to side and/or forward and back in response to position of the hockey puck and/or hockey player 72 as determined by the sensor(s), not shown, thus training the hockey player to focus on the goal 71 and the simulated opponent 74 (reaction time) and to shoot the hockey puck away from simulated defender 74 (placement memory). When used, puck machine control 76 can cause a puck machine to project a hockey puck to the side of the hockey rink occupied by player 72 and opponent control 75 can activate and/or move simulated opponent(s) 74 to defend net 71 consistent with the movement of hockey player 72 and hockey puck and with an opponent having as selected skill level and the trajectory, force and direction of the hockey puck projected to the side of the hockey rink occupied by the hockey player 72 being trained. As in the case of tennis, application of the method and apparatus for training sports skills for training hockey skills not only builds muscle memory in repetition of handling and shooting hockey pucks projected by the ball machine(s), the presence of simulated defenders provides the opportunity to provide reaction time and placement memory training in the brain of the hockey player 72.

Figure 18:
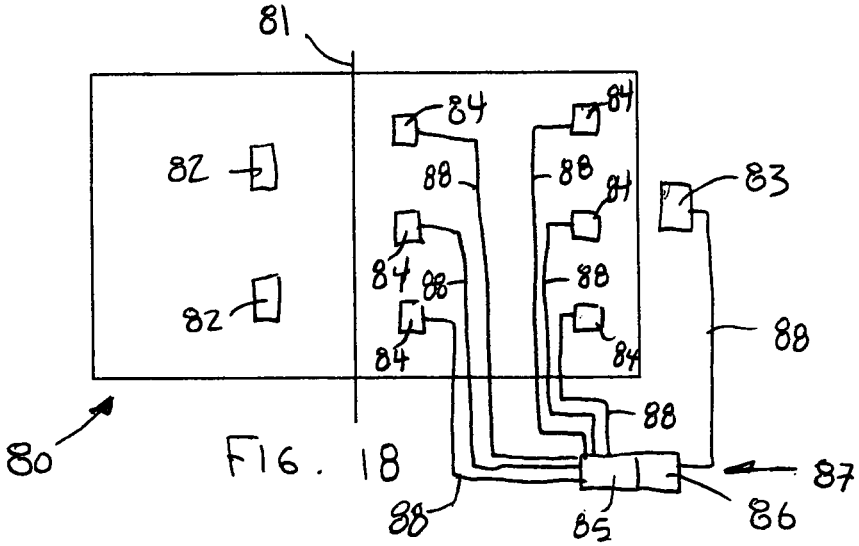
FIG. 18 is a schematic view of a volleyball court showing application of sports training method and apparatus according to the invention being used to train a volleyball player.

Turning to FIG. 18 application of the method and apparatus for training sports skills according to the invention to the game of volleyball can be seen. In FIG. 18 a schematic volleyball court 80 can include a net 81. One or more volleyball players 82 being trained can be positioned on volleyball court 80 depending on the type of shot player(s) 82 will be practicing such as setting and spiking, returning, etc. While two players 82 being trained are shown in FIG. 18, it should be understood that one or more than two players can be trained together according to the method and apparatus of the present invention. One or more volleyball projecting machines 83 can be provided along the back line or other locations at one end of the volleyball court. Volleyball projecting machines are well known in the art. While one ball machine is shown in FIG. 18, the training method and apparatus according to the invention contemplates use of one or more volleyball machines depending on the skill level selected for the opponents and the capability of the volleyball machines to project volleyballs in a variety of directions as well as speeds and elevations. A plurality of simulated opponents 84 can be provided on the side of the volleyball court 80 where the volleyball machine 83 is positioned. While six simulated opponents 84 are shown in FIG. 18, one or more simulated opponents can be provided depending on the capabilities of the simulated opponents 84, the kind(s) of shots to be practiced and the skill level to be simulated.

Simulated opponents 84 can be similar to the simulated opponents described in FIG. 8 through FIG. 15 except that the configuration of the opponent can be modified to simulate the form and appearance of a volleyball player and can be further modified to eliminate a tennis racket. Volleyball machine 83 can have a ball machine control 86 to control operation of the volleyball machines to project a plurality of volleyballs to the side of the volleyball court occupied by volleyball players 82. Simulated opponents 84 can be provided with an opponent controller 85 to control the activation and location of simulated opponents 84. Simulated opponents 84 and/or opponent controller 85 can be provided with a power source as described above. For the game of volleyball opponents 84 can be arranged to pop-up vertically to simulate an opponent jumping to block or return volleyballs, or can be arranged to simulate the height and position of an opponent that has jumped up to block or return a volleyball, or can be arranged to simulate an opponent positioned further back in the court that is not required to jump. Those skilled in the art will understand that control lines 88 shown schematically in FIG. 18 can be mechanical lines to move simulated opponents 84 or can be electrical lines to operate selected ones of simulated opponents 84 to appear as described above. Those skilled in the art will also understand that control lines 88 can be wireless electromagnetic connections to the simulated opponents 84 and ball machine 83. Opponent controller 85 and ball machine controller 86 can be combined in a volleyball controller 87 that can function in a like manner as the tennis controller 28 as described above. Ball machine control 86 can cause a volleyball machine 83 to project a volleyball to the side of the volleyball court occupied by players 82 and opponent control 85 can activate and/or move simulated opponent(s) 84 to defend consistent with an opponent having as selected skill level and the trajectory, force and direction of the volleyball projected to the side of the volleyball court occupied by the volleyball players 82 being trained. As in the case of tennis, application of the method and apparatus for training sports skills for training volleyball skills not only builds muscle memory in repetition of setting, passing, striking or otherwise handling volleyballs projected by the ball machine(s), the presence of simulated defenders provides the opportunity to provide placement memory training in the brain of the volleyball players 82. While two volleyball players 82 being trained are shown in FIG. 18, it should be understood that the method and apparatus for training volleyball skills according to the invention is applicable to training one or more than two players simultaneously.

While the invention has been specifically described in connection with certain specific embodiments thereof, it is to be understood that this is by way of illustration and not of limitation, and the scope of the appended claims should be construed as broadly as the prior art will permit.

I claim:

1. A method for training sports skills for a game conducted on a playing surface that includes striking a game object away from an opponent comprising:

sequentially projecting a plurality of game objects toward one portion of said playing surface for striking by one or more players being trained; and sequentially causing one or more simulated opponents to appear at two or more locations on said playing surface in connection with projection of a game object to train said player to strike game objects away from an opponent;

wherein said one or more simulated opponents are controlled by a controller and wherein said method includes setting said controller to operate said one or more simulated opponents to simulate one or more players having a selected skill level.

2. The method of training sports skills of claim 1 wherein said step of sequentially projecting a plurality of said game objects comprises a machine for sequentially projecting a plurality of game objects toward said one portion of said playing surface for striking by said one or more players being trained.

3. The method of training sports skills of claim 1 wherein said game is selected from a group including ice hockey, soccer, tennis and volleyball.

4. A method for training tennis skills of a tennis player comprising:

sequentially projecting a plurality of tennis balls toward one side of a tennis court for return by said tennis player; and sequentially causing one or more simulated opponents to appear at two or more locations on the opposite side of said tennis court in connection with projection of a tennis ball to train said tennis player to return tennis balls away front an opponent thereby teaching said tennis player to play the tennis court and training placement memory in the brain of said tennis player in addition to training muscle memory by returning said tennis balls;

wherein said one or more simulated opponents are controlled by a controller and wherein said method includes setting said controller to operate said one or more simulated opponents to simulate one or more tennis players having a selected skill level.

5. The method of training tennis skills of claim 4 wherein said step of sequentially projecting a plurality of tennis balls comprises a trainer sequentially hitting a plurality of tennis balls toward said one side of a tennis court.

6. The method of training tennis skills of claim 4 wherein said step of sequentially projecting a plurality of tennis balls comprises one or more tennis ball machines projecting said plurality of tennis balls, and said step of sequentially projecting a plurality of tennis balls includes projecting said tennis balls in selected combinations of direction, speed, elevation and spin.

7. The meted of training tennis skills of claim 4 wherein said step of operating said one or more simulated opponents comprises operating one or more simulated opponents to simulate one or two tennis players moving to a plurality of locations on the opposite side of the tennis court.

8. The method of training tennis skills of claim 7 wherein said simulated opponents comprise a plurality of stationary simulated opponents located in selected locations on the opposite side of said tennis court and said step of operating said one or more simulated opponents comprises operating selected ones of said simulated opponents to cause an opponent to selectively appear at said one or more of said locations.

9. The method of training tennis skills of claim 7 wherein said simulated opponents comprise one or more movable simulated opponents and said step of operating said one or more simulated opponents comprises operating selected ones of said simulated opponents to move said one or more simulated opponents to selectively appear at two or more of a plurality of locations on the opposite side of the tennis court.

10. The method of training tennis skills of claim 4 wherein said method includes setting said controller to simulate one or more of the following skill levels, grade school, high school, college, professional, recreational, singles and doubles.

11. The method of training tennis skills of claim 4 wherein said method includes setting said controller to simulate the play of one or more professional tennis players.

* * * * *